US005127446A

United States Patent [19]

Marelin

[11] Patent Number: 5,127,446

[45] Date of Patent: Jul. 7, 1992

[54] BANDING TOOL WITH A FORCE STORING DEVICE

[75] Inventor: Miklos B. Marelin, Denver, Colo.

[73] Assignee: Band-It-Idex, Inc., Denver, Colo.

[21] Appl. No.: 594,377

[22] Filed: Oct. 5, 1990

[51] Int. Cl.[5] ..... B21F 09/02

[52] U.S. Cl. ..... 140/93.4; 140/123.6; 140/150

[58] Field of Search ..... 140/93.2, 93.4, 123.6, 140/150, 152, 153, 154

[56] References Cited

U.S. PATENT DOCUMENTS

| | | | |
|---|---|---|---|
| 2,087,655 | 7/1937 | Prestwich | 81/9.1 |
| 2,349,608 | 5/1944 | Bramble | 140/93.4 |
| 3,344,815 | 10/1967 | Lawson et al. | 140/93.2 |
| 4,041,993 | 8/1977 | Angarola | 140/93.4 |
| 4,646,393 | 3/1987 | Young | 24/20 |
| 4,726,403 | 2/1988 | Young et al. | 140/93.4 |
| 4,733,701 | 3/1988 | Loisel et al. | 140/123.6 |
| 4,928,738 | 5/1990 | Marelin et al. | 140/93.4 |

FOREIGN PATENT DOCUMENTS

| | | | |
|---|---|---|---|
| 658135 | 2/1963 | Canada | 140/117 |

*Primary Examiner*—Lowell A. Larson
*Attorney, Agent, or Firm*—Sheridan, Ross & McIntosh

[57] ABSTRACT

A banding tool (10) is provided for tensioning a band clamp (12) around a protective shield (17). The tool (10) comprises a housing (20) having a hollow handle (22) and a head receptacle (34). Pivotally attached to the housing (20) is a pull up handle (116) and a cutoff handle (154). Received within the hollow handle (22) is a tensioning assembly (24) comprising a force storing device (26), a plunger (28), an adjustment screw (30) and a connecting rod (32). Attached within a head receptacle (34) of the housing (20) is a head (36). The head (36) contains a tension block (46) which is slidably received therein. A tension transfer lever interconnects the assembly (24) and the block (46) for tensioning of the band (13). The force storing device (26) is precompressed to approximately equal the desired tension on the band (13). Once the tension in the band (13) approximately equals the precompression of the force storing device (26), the operator is provided with a signal by the locking of the pull up handle (116). The cutoff handle (154) is then actuated to move a cutoff knife (180) into bending/cutting cooperation with a cutoff blade (86).

31 Claims, 10 Drawing Sheets 14
18
15
13
13
13
244
246
248
15
13
180b
240
238
242
234
86b
224
240
236
242

BANDING TOOL WITH A FORCE STORING DEVICE

TECHNICAL FIELD OF THE INVENTION

This invention relates in general to banding tools, and in particular to a method and apparatus for tensioning a band with a tool having a force storing device.

BACKGROUND OF THE INVENTION

The use of a hand tool to tighten a band clamp has long been known. Band clamps are typically used to secure bundles of materials together and to secure pipes, wiring, etc. In one such application, a band clamp is applied to secure a protective metal braiding around a bundle of wiring which is connected to a plug or coupler known as a back shell.

Back shells are frequently used in military and aerospace applications where wiring carrying low voltage signals are conducted. Both the cables and the connectors must be protectively covered with a metallic substance to limit the harmful effects of radiation thereon. This metallic shielding must be without any "windows" (openings) and must in all parts have a ground connection with only low resistance to effectively minimize any electrical potential this "shielding" system may receive due to external or internal electromagnetic radiation (such as radio emission, cosmic rays, lightning strike, explosion of an atomic device, etc.). The diameter of the back shell body is typically larger than the diameter of the cable entering thereinto, and in order to have a satisfactory interconnection, a banding tool must be capable of applying a band clamp proximate the intersection of the back shell body and the cable entry stem. Thus the banding tool should be approximately the same width as the band clamp to be applied and should be capable of applying the band clamp from any direction.

One tool for tightening band clamps to a back shell is disclosed in U.S. Pat. No. 4,726,403, to Young et al., Feb. 23, 1988. The Young et al. device uses a toggle arrangement to tension the band clamp in place. Upon reaching the appropriate tension in the band clamp, the tool locks in a closed condition. To sever the tail from the tightened band clamp, a cutting arm must be rotated outwardly and upwardly from the side of the banding tool.

Due to the externally attached cutting device, the Young et al. banding tool is capable of applying a band clamp close to the back shell from only one direction. If a band is attempted to be connected from the opposite direction, the cutting device may prevent proper installation. The Young et al. tool is therefore limited in its application and becomes difficult to operate in confined spaces such as are found in aircraft fuselages.

Additionally, Young's tool uses toggles to transfer tension and toggles generally have a short power stroke in order to make the tool usable by an average person. Therefore, a larger size tool is required to sufficiently tension the band.

Another banding tool is disclosed in U.S. Pat. No. 4,928,738 to Marelin et al., May 29, 1990, assigned to the same assignee as the present invention. The '738 tool uses toggles to provide the power stroke and counteracting springs to achieve the desired tension in a band. It is necessary to force the band to bend around internal portions of the tool during tensioning. Additionally, the tool is not designed with overall width as a primary consideration.

Still another banding tool is disclosed in U.S. Pat. No. 2,087,655 to Prestwich, Jul. 20, 1937, the '655 device has a gripper section which holds one end of the band to be tensioned while a tensioning section grips and pull the other end of the band. The tensioning section comprises a double set of knurled wheels with a first set fixed and a second set movable. While the first set prevents slippage of the band, the second set tensions the band. While there is an angle between the tensioning section and the gripper section, this angular relationship does not provide the advantages of the present invention. Thus there is a need for a method and apparatus to allow tensioning of a band clamp to a back shell from either direction.

SUMMARY OF THE INVENTION

The present invention disclosed herein comprises a method and apparatus for a banding tool using a force storing device which substantially eliminates or reduces problems associated with prior banding tools. The present invention allows the installation of a band to a coupling in which the tool must be placed proximate the coupling from either side thereof.

In accordance with one aspect of the invention, a tool for tensioning a band is provided. The tool comprises a tensioning means having a first longitudinal axis therethrough. Means for transferring tension from the tensioning means to the band is interconnected to the tensioning means at an angle thereto.

The tensioning means comprises a force storing device within a hollow handle of the tool. A tension adjustment plunger, a tension adjustment screw and a connecting rod are interconnected to the force storing device and the means for transferring tension. In a preferred embodiment the force storing device comprises a compression spring which is precompressed a desired amount by the adjustment plunger.

The means for transferring tension comprises a tension transfer lever interconnected to the tensioning means and a tensioning block. At least one push link is connected on a first end thereof to the tensioning means and on a second end to the lever arm. A tension block having an elongated slot and a tension pin therein is connected to the lever arm, wherein the tension block pulls the band into tension.

It is a technical advantage of the present invention that a band may be tensioned around a back shell from either direction. It is a further advantage of the present invention that a precompressed spring is used for achieving a desired tension in the band. It is a still further advantage of the present invention that levers are used to transfer tension rather than toggles resulting in a more work efficient tool.

BRIEF DESCRIPTION OF THE DRAWINGS

For a more complete understanding of the present invention and for further advantages thereof, reference is now made to the following Detailed Description taken in conjunction with the accompanying Drawings, in which.

DETAILED DESCRIPTION OF THE INVENTION

Figure 1:
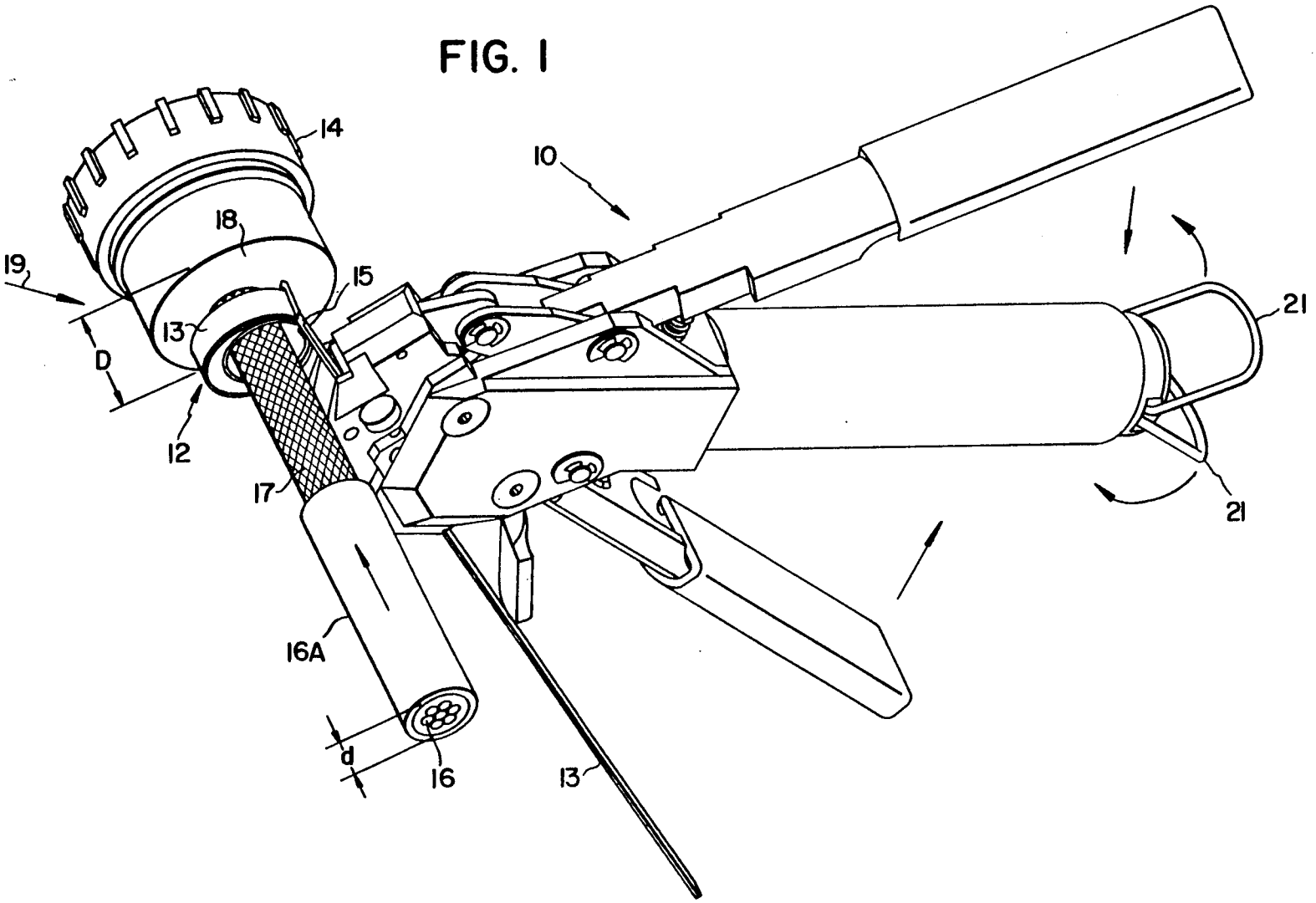
FIG. 1 is a perspective view of a tool constructed in accordance with the preferred embodiment of the present invention in use.

Referring first to FIG. 1, a perspective view of a tool constructed in accordance with the preferred embodiment of the present invention is generally identified by the reference numeral 10. The banding tool 10 is used to attach a band clamp 12 comprising a band 13 and a buckle 15 to a coupler 14 such as, for example, a back shell. The band clamp 12 is used to secure a protective shield 17 covering a cable 16 which is in turn attached to the coupler 14. Optional protective cover 16*a* such as heat shrink tubing can be installed to cover the shield 17 and the buckle 15.

Due to a larger diameter D of the coupler 14 in comparison to a diameter d of the shield 17, a flange 18 is formed proximate the connection therebetween. As a result of the banding tool 10, the band clamp 12 may be positioned proximate the flange 18 as required for the preferred connection configuration. Also, due to the symmetrical design of the tool 10, the band clamp 12 may be positioned proximate the flange 18 from either direction (i.e. the tool 10 may also be used to apply the clamp 12 from a direction indicated by an arrow 19, directly opposite the direction as shown in FIG. 1) with equal success. It should be noted that the tool 10 may be provided with handle locks 21 that allow the tool 10 to be stored in a more compact and space efficient manner.

Figure 2A:
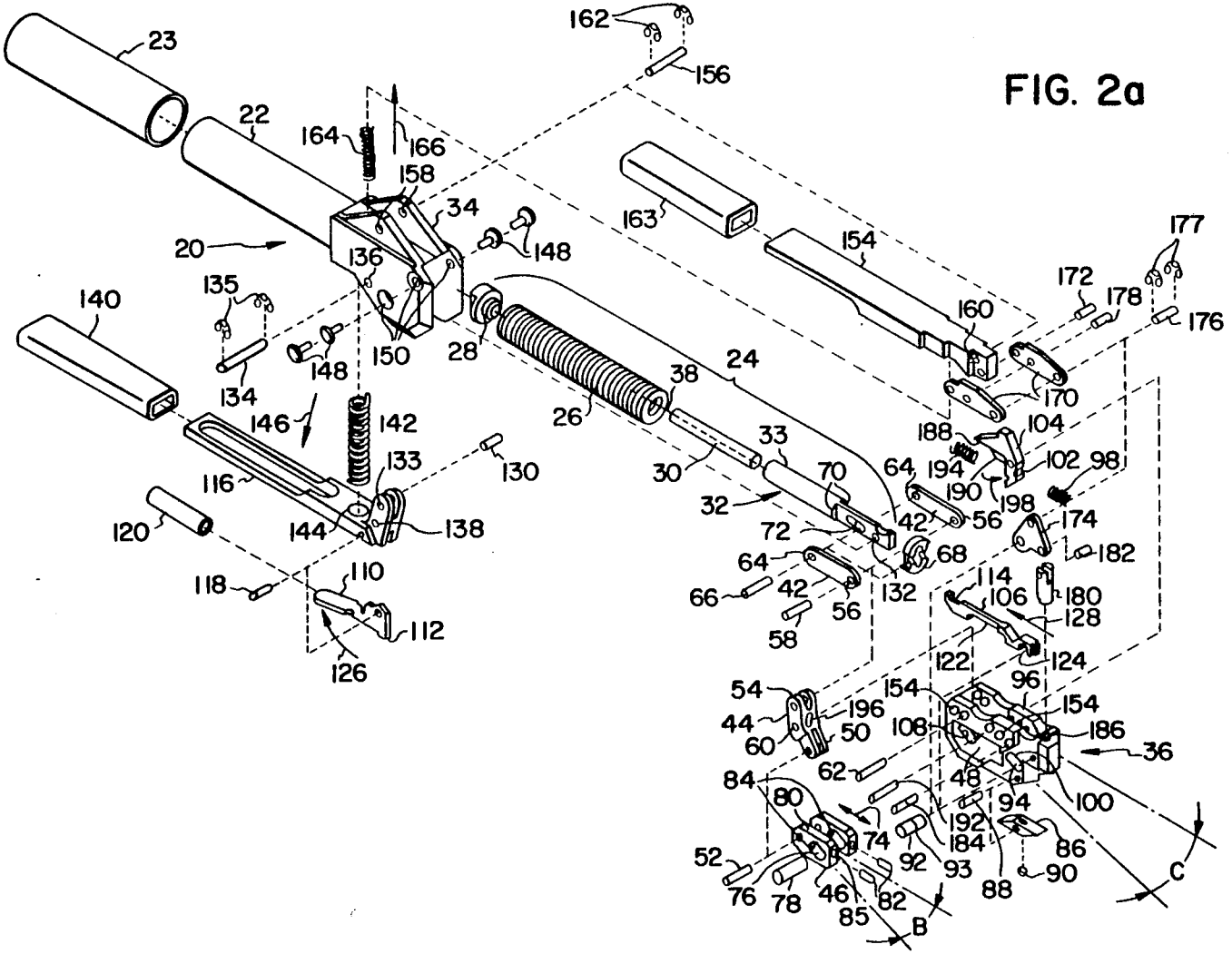
FIGS. 2*a, b,* and *c* are exploded perspective views of the tool of the present invention.
Figure 2C:
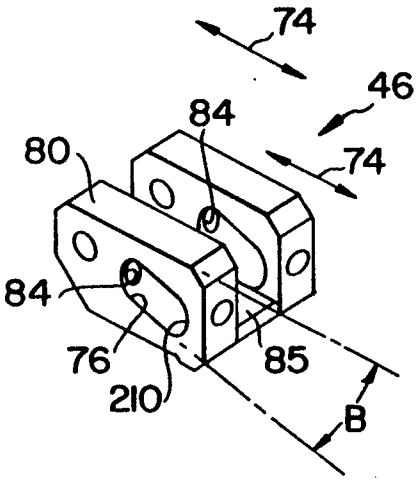
Figure 2B:
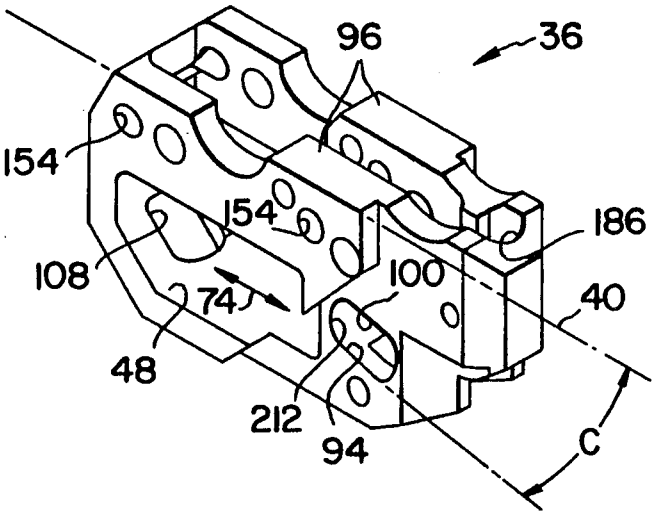

Referring simultaneously to FIGS. 2*a*, 2*b* and 2*c*, an exploded perspective view of the tool 10 is shown. A housing 20 receives and interconnects the various parts of the tool 10. Within a hollow handle 22 (the handle 22 may be provided with a protective covering 23 of a pliant material for comfort during use) of the housing 20 is a tensioning assembly 24. The tensioning assembly 24 comprises a force storing device 26, a tension adjustment plunger 28, a tension adjustment screw 30 and a connecting rod 32. The device 26 may comprise, for example, a compression spring, a rubber block or any other device capable of storing energy. Alternatively, the device 26 may comprise a power unit such as a hydraulic or pneumatic cylinder for powered actuation of the tool 10.

The screw 30 is threadably received into a tubular portion 33 of the rod 32. The plunger 28, upon assembly, is secured to the adjustment screw 30 to precompress the device 26 by threading into or out of the tubular portion 33 of the rod 32. A special tool (not shown) is preferably required to turn the plunger 28 and thus the screw 30 to prevent unauthorized changing of the setting of the desired precompression of the device 26. As will be subsequently described in greater detail, the device 26 is precompressed to allow a desired tension to be applied to the band clamp 12 around an object to be clamped.

The housing 20 also comprises a head receptacle 34 in which a head 36 (See FIG. 2*b*) is operably interconnected to the tensioning assembly 24. It is an important aspect of the present invention to note that upon assembly, a linear axis 38 passing through the tensioning assembly 24 intersects a linear axis 40 through the head 36 at an angle A (see FIG. 3*a*). The angle A may vary so long as the axis 38 and the axis 40 are not parallel to each other. The angular relationship between the assembly 24 and the head 36 allows the band 13 to be inserted into and through the tool 10 without the necessity of bending around an obstruction in the tool 10. Therefore, in comparison to prior devices the tool 10 is easy to load and most of the force in the tool 10 is used to tension the band 13 rather than to bend the band 13 around an obstruction.

The head 36 is interconnected to the assembly 24 by push links 42, tension transfer lever 44 and tension block 46. The tension block 46 is slidably inserted into a cavity 48 in the head 36 and connected to a first end 50 of the lever 44 by a pin 52. The lever 44 is also pivotally connected through a center hole 60 to the head 36 by a pin 62. A second end 54 of the lever 44 is pivotally connected to a first end 56 of the links 42 by a pin 58.

The links 42 are connected at a second end 64 to the connecting rod 32 by a pin 66. A support plunger 68 is secured to the rod 32 forcing pin 66 against forward end of elongated slot 72 on the rod 32 through which the pin 66 is positioned. Due to the slot 72, the pin 66 has a predetermined travel distance along the linear axis 38, as will be subsequently described in greater detail.

The cavity 48 in the head 36 is dimensioned to allow the tension block 46 to slide in a back-and-forth direction as indicated by a double-headed arrow 74. Received within an elongated slot 76 (see FIG. 2*c*) in the tension block 46 is a tension pin 78. The slot 76 is formed at an angle B (which may comprise, for example 10°–17°) relative to a top surface 80 of the block 46 to allow pressure to be applied and released by the tension pin 78 to the band 13 of the band clamp 12, as will be subsequently described in greater detail. A pair of springs 82 are inserted into holes 84 in the block 46 to bias the pin 78 toward an edge 210 (see FIG. 2*c*) of the slot 76 and into contact with the band 13 of the band clamp 12 which passes therebetween and a bottom surface 85 of the block 46.

A tension holding pin 92 is slidably received within an elongated slot 94 in the head 36. The pin 92 is held within the slot 94 by engagement of a groove 93 therein by a tension hold/release link 106. Thus the width of the tool 10 at the head 36 is kept to approximately the same width as the buckle 15.

The slot 94 is formed at an angle C (which may comprise, for example, 10°–17°) relative to a top surface 96 of the head 36 (see FIG. 2*b*). The pin 92 is biased away from an edge 212 of the slot 94 by a spring 98 which fits through the head 36 in opening 100. The spring 98 is held in place by a recess 102 in a tension holding hook 104. The band 13 of the band clamp 12 is gripped between the tension holding pin 92 and a cut-off blade 86. Thus the tension holding pin 92 is biased to hold the band 13 from slipping or being pulled from the tool 10. The cut-off blade 86 may be reversibly fixed within the head 36 by a pin 88. A jam screw 90 is threadable into the blade 86 to hold pin 88 in place and to provide convenient means to remove cut-off blade 86.

The tension hold/release link 106 fits within the head 36 through an opening 108 for cooperation with a tension hold/release hook 110. The link 106 and hook 110 are interconnected by the mating of a male portion 112 on the hook 110 with a slot 114 on the link 106. The hook 110 is pivotally connected to a pull-up handle 116 by a pin 118. The hook 110 may be provided with a pliant cover 120 for comfort of use.

The link 106 has a first cut-out 122 and a second cut-out 124. When the link 106 is installed within the head 36, the first cut-out 122 interacts with the tension pin 78 of the tension block 46 while the second cut-out 124 interacts with the tension holding pin 92 within the elongated slot 94 of the head 36. By actuating the hook 110 in a direction indicted by an arrow 126 the hook 110 pivots about the pin 118 to pull the link 106 in a direction indicated by an arrow 128.

The first cut-out 122 and the second cut-out 124 thus contact the tension pin 78 and the tension holding pin 92, respectively, and pull the pins against their spring bias. Thus, an operator is able to insert a band 13 of the band clamp 12 without interference from the tool 10.

The link 106 also provides an automatic self adjustment when clamping various materials such as steel versus rubber. For example, if the band clamp 12 encircles a rubber tube, there will be a greater tendency (than with steel) for the rubber to try to reexpand and to pull the tension holding pin 92 into the elongated slot 94 away from the edge 212 (thus gripping the band 13 tighter). This forward motion of pin 92 would reduce the total stroke tool 10 could apply to band 13, resulting in lower tensioning force. Due to the interconnection with the tension pin 78 through the link 106, the tension pin 78 will be similarly allowed to move farther into its elongated slot 76 toward the edge 210 for greater gripping strength, thus adjusting automatically for a longer stroke.

The pull up handle 116 is pivotally connected to the connection rod 32 by a pin 130 passing through holes 132 and 133. The pull up handle 116 is pivotally connected to the head receptacle 34 by a pin 134 through a hole 136 in the head 34 and a hole 138 in the handle 116 and is held in position by snap rings 135. The handle 116 may be provided with a pliant cover 140 for comfort of operation. A spring 142 is inserted into a receptacle 144 in the handle 116 and into the head receptacle 34 to bias the handle 116 in a direction indicated by an arrow 146.

A plurality of bolts 148 fit into holes 150 in the head receptacle 34 and are threadably received by the head 36 within holes 152 therein. Thus, the head 36 is secured within the head receptacle 34 by the bolts 148.

A cutoff handle 154 is pivotally attached to the head receptacle 34 by a pin 156, secured in place by a pair of snap rings 162, passing through holes 158 in the receptacle 34 and a hole 160 in the handle 154. A spring 164 is positioned between the handle 154 and the head receptacle 34 to bias the handle 154 in a direction indicated by an arrow 166. The handle 154 may also be provided with a pliant cover 168 for comfort of operation.

A pair of cutoff links 170 are pivotally attached to the handle 154 by a pin 172. The cutoff links 170 are pivotally attached at an end opposite the handle 154 to a cutoff arm 174 by a pin 176 which is held in place by snap rings 177. A pin 178 passes through the links 170 for interaction with the tension holding hook 104, as will be subsequently described in greater detail. The cutoff arm 174 is pivotally connected to a cutoff knife 180 by a pin 182 and to the head 36 by a pin 184. The cutoff knife is slidably received within a receptacle 186 in the head 36 for cooperation with the cutoff blade 86 to sever the band 13, as will be subsequently described in greater detail.

The tension holding hook 104 has a hook 188 and a cam surface 190. The tension holding hook 104 is pivotally connected to the head 36 by a pin 192. A spring 194 is received by the tension holding hook 104 and a receptacle 196 in the tension transfer lever 44. The spring 194 biases the tension holding link 104 in a counterclockwise direction, as indicated by an arrow 198, about the pin 192.

Figures 3A, 3B:
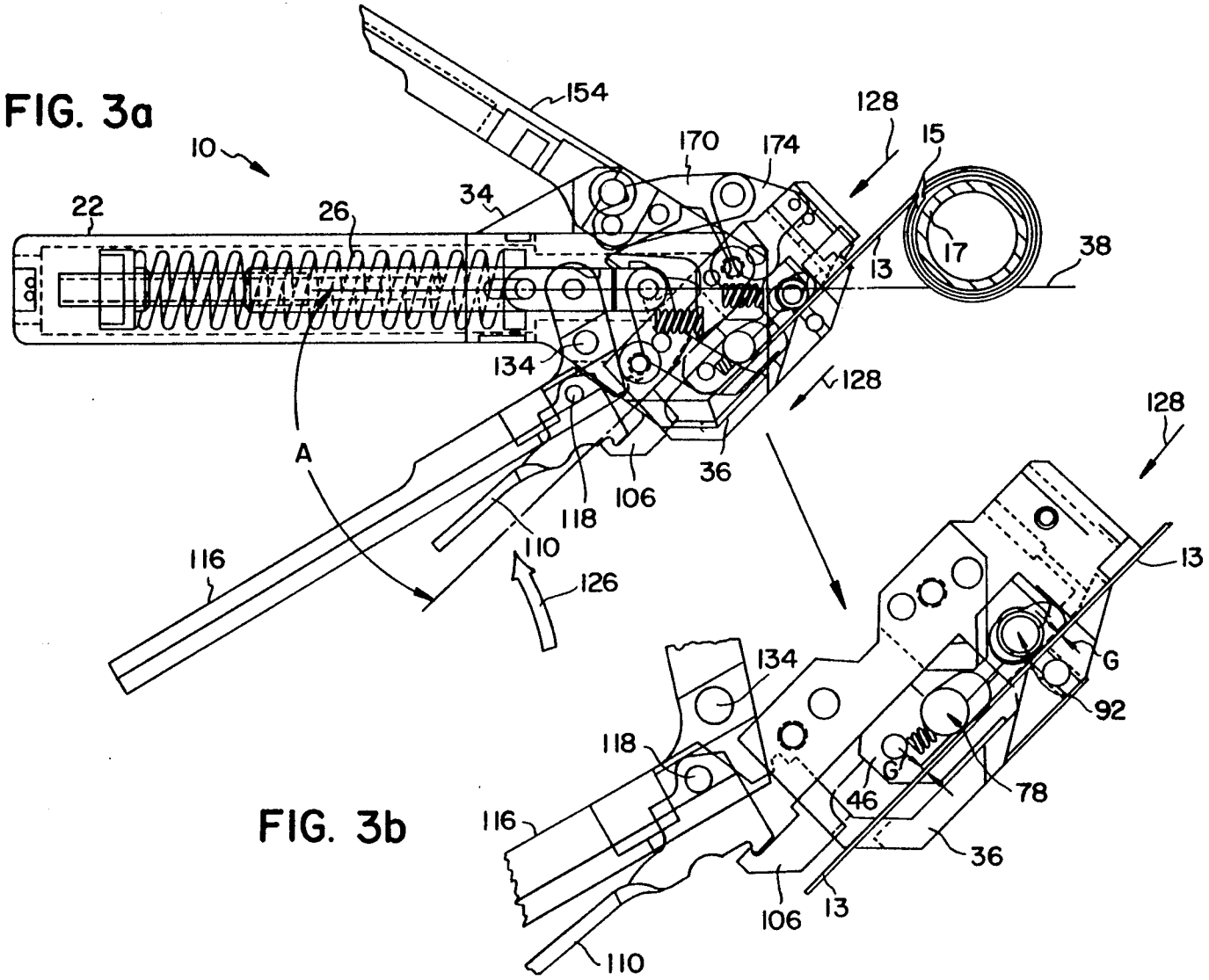
FIGS. 3*a* and *b* are cross-sectional views of the tool with a band clamp to be tensioned being inserted therein.

The operation of the tool 10 will now be discussed with reference to FIGS. 3 through 8. Referring first to FIGS. 3*a* and 3*b*, the insertion of a band clamp 12 into the tool 10 is illustrated. With the pull up handle 116 and the cutoff handle 154 in their spring biased positions, the tension hold/release hook 110 is grasped by an operator and moved in the direction 126. Movement of the hook 110 in the direction 126 causes the tension hold/release link 106 to move in the direction 128. Thus, the tension pin 78 and the tension holding pin 92 are moved in their respective holes against their spring bias to form gaps G therebetween and the bottom surface 85 of the tension block 46 and the cutoff blade 86 which are at least slightly greater than the thickness of the band 13. The gaps G thus formed allow the band 13 to be inserted in the direction 128 into the tool 10. Due to the angle A between the linear axis 38 of the tensioning means 24 and the linear axis 40, the band 13 is maintained straight without the necessity of bending thereof around internal parts of the tool 10. Thus, tensioning of the band 13 and insertion thereof into the tool 10 is relatively easier than in prior art devices.

Figures 4A, 4B, 4C:
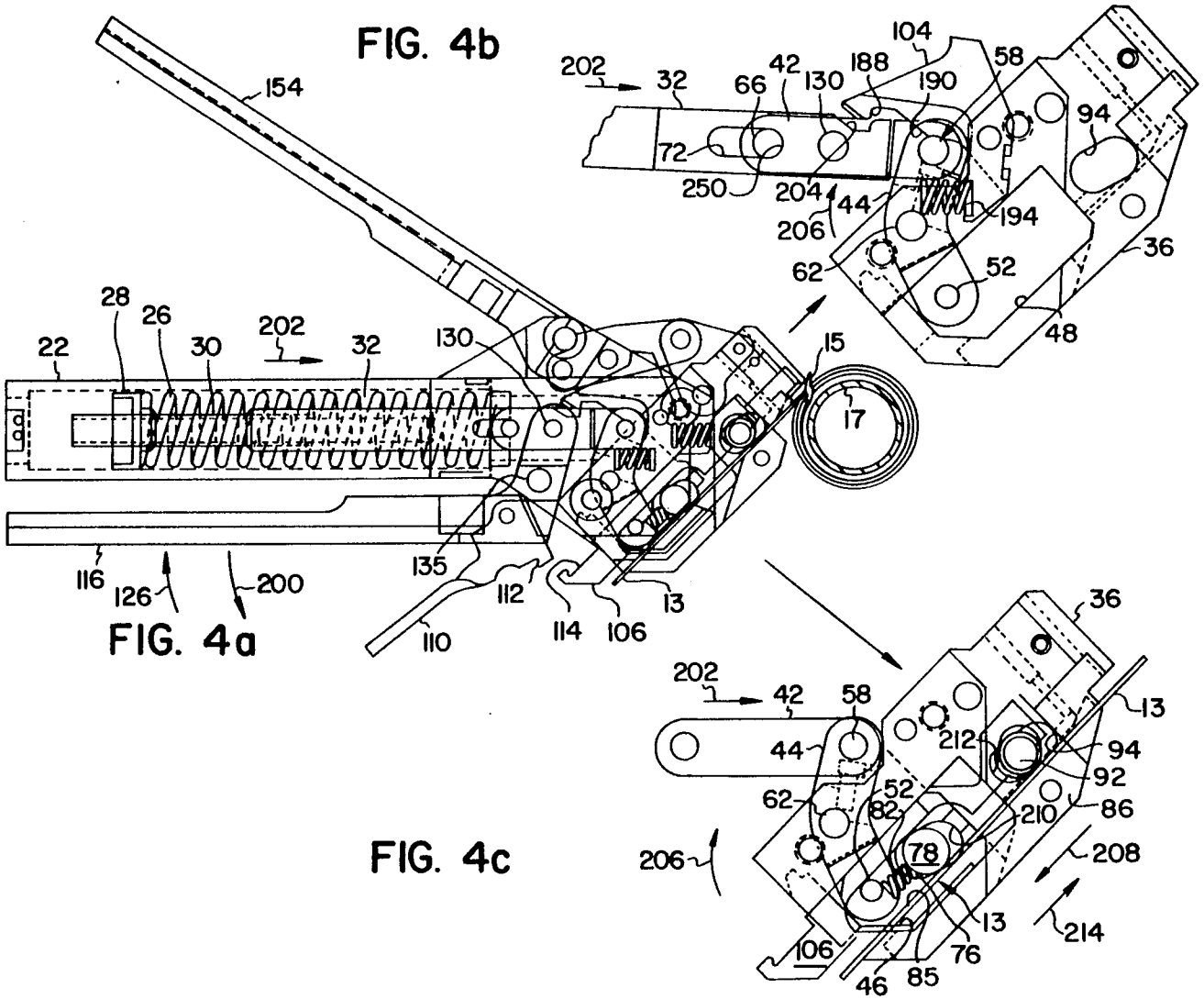
FIGS. 4*a*, *b* and *c* are cross-sectional views of the tool in an upstroke position.

Referring to FIGS. 4*a*, 4*b* and 4*c* the tool 10 is shown in the tensioning mode. The pull up handle 116 is pulled back-and-forth as indicated by the arrow 126 and an arrow 200 between the position as shown in FIG. 4*a* and the position as shown in FIG. 3*a*. As the handle 116 is moved in the direction 126, the tension hold/release hook 110 is not engaged with the tension hold/release link 106.

As the handle 116 pivots about the pin 135, the connecting rod 32 is moved in a direction indicated by an arrow 202 as a result of the interconnection thereto by the pin 130. As can be seen in FIG. 4*b*, movement of the rod 32 similarly causes movement of the push links 42 in the direction 202. Movement of the links 42 in the direction 202 is caused by the pin 66 engaging a front edge 250 of the slot 72 in the connecting rod 32. The pin 66 is held against the edge 250 by the support plunger 68 which is in turn pushed in the direction 202 by the storing device 26. As long as the tension in the band 13 does not overcome the precompression of the device 26 the pin 66 is held against the edge 250. In other words, the assembly 24 acts as a solid rod until the band 13 reaches the predetermined tension.

Therefore, as the link 42 moves in the direction 202 the tension transfer lever 44 is forced to pivot in a clockwise direction as indicated by an arrow 206 about the pin 62 as a result of the interconnection therebetween with the link 42 by pin 58. As the pin 58 moves in the direction 202 it slides along the cam surface 190 of the tension holding hook 104 against the bias of the spring 194 and the hook 188 thereof is held out of the slot 204 in the connecting rod 32. Thus, an operator knows that the band 13 has not been tensioned the desired amount and further cycling of the handle 116 is required.

Referring to FIG. 4c, as the link 42 moves in the direction 202, the transfer lever 44 pivots in the clockwise direction 206. Due to the interconnection between the lever 44 and the tension block 46 by the pin 52, the tension block 46 is moved in a direction indicated by an arrow 208. Movement of the tension block 46 in the direction 208 forces the tension pin 78 toward the edge 210 of the elongated slot 76 therein, and the band 13 is gripped between the pin 78 and the bottom surface 85 of the block 46. Thus as the handle 116 moves in the direction 126, the band 13 is moved in the direction 208 to increase the tension therein. As the band 13 is moved in the direction 208 by the pin 78 and the block 46, the pin 92 is moved toward the edge 212 of the elongated slot 94. Thus the band 13 is allowed to pass between the pin 92 and the cut-off blade 86.

When the handle 116 is moved in the direction 200, the block 46 is moved in a direction indicated by an arrow 214. As the block 46 moves in the direction 214, tension in the band 13 causes the band 13 to also try to move in the direction 214. The tension in the band 13 and the bias of the spring 98 thus moves the pin 92 away from the edge 212 in the slot 94 and holds the band 13 from movement in the direction 214. Similarly, movement of the block 46 in the direction 214 causes the pin 78 to move against the bias of the spring 82 and away from the edge 210 in the slot 76, allowing the pin 78 to pass freely over the band 13. Therefore, the handle 116 is cycled in the direction 126 and 200 as described to gradually tension the band 13 around the shield 17.

It is an advantage of the tool 10 that the handle 116 and lever 44 is used rather than toggles, as are found in the prior art. The handle 116 and the lever 44 provide a mechanical advantage over toggles allowing fewer cycles of the handle 116 to move the band farther than in a corresponding toggle tool. Although not shown, it is to be understood that by varying the length of the lever 44 about the pin 62, various mechanical advantages may be achieved. Additionally, the use of the force storing device 26 such as a precompressed spring allows the tool 10 to be smoother, easier to operate and more accurate than prior devices.

Figure 5B:
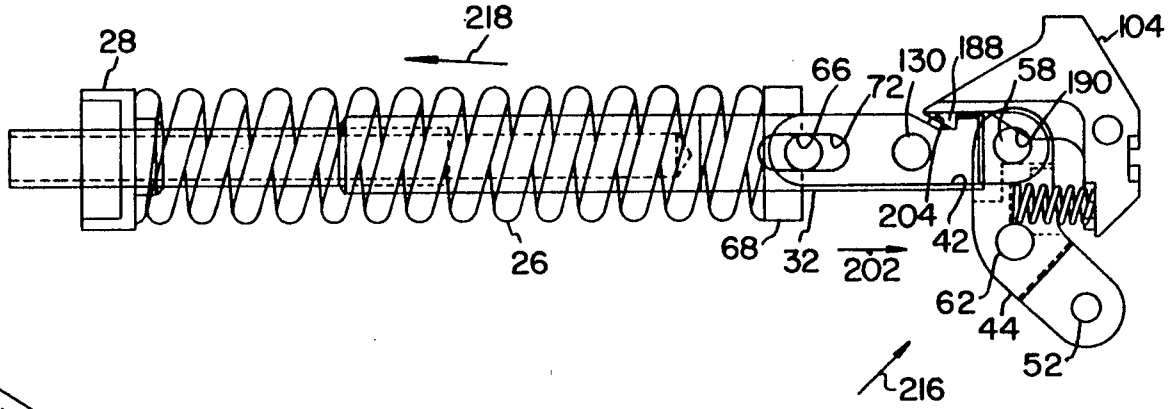
FIGS. 5*a* and *b* are cross-sectional views of the tool in the signal position.
Figure 5A:
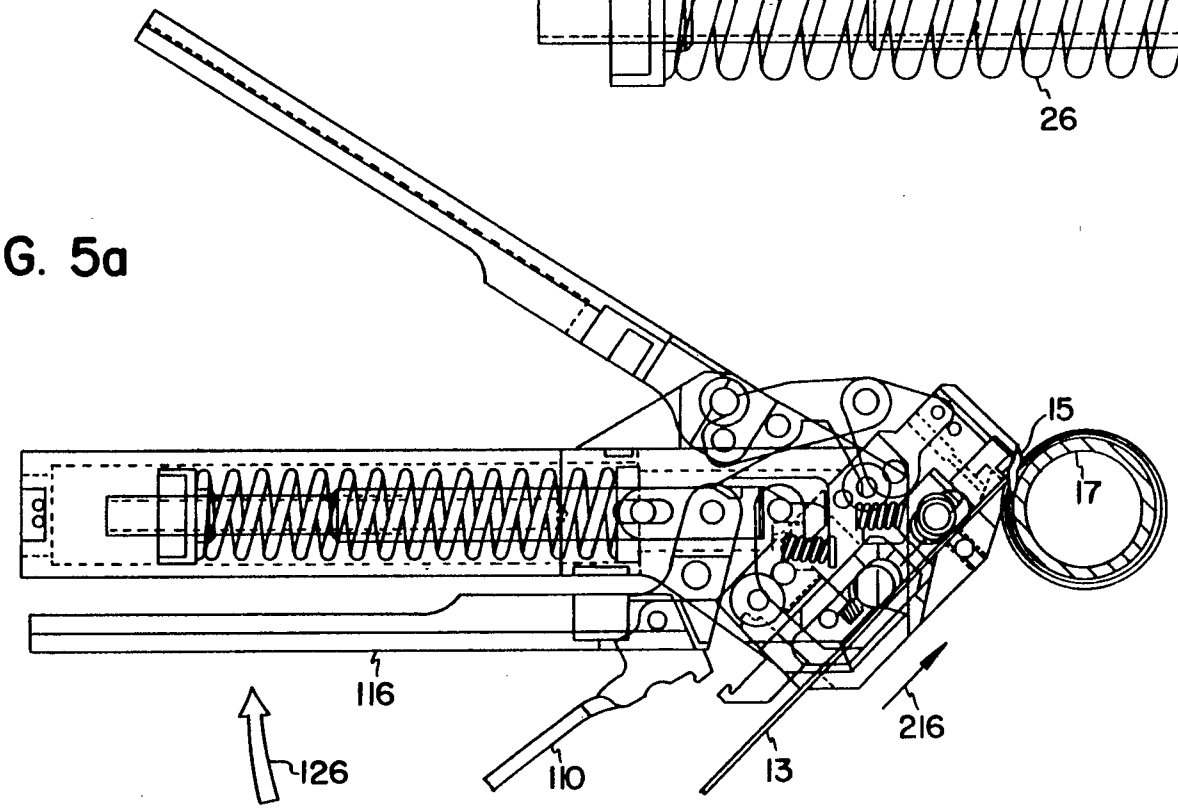

Referring to FIGS. 5a and 5b, the band 13 has been pulled to the desired tension within the tool 10. When the desired tension is reached, the handle 116 is locked in the position as shown in FIG. 5a. In the locked condition, the spring 142 (see FIG. 2a) is unable to return the handle 116 to the position shown in FIG. 3a, and the operator knows that the desired tension has been reached.

As best seen in FIG. 5b, when the tension in the band 13, as indicated by an arrow 216, exceeds the precompression of the storing device 26, the device 26 further compresses in a direction indicated by an arrow 218. Thus the support plunger 68 and the pin 66 also move in the direction 218 as the connecting rod 32 moves in the direction 202. Since the pin 58 is also connected to the push links 42, the pin 58 does not move in the direction 202 and does not ride along the cam surface 190 of the tension holding hook 104. Thus the hook 188 thereon enters the slot 204 on the connecting rod 32 to lock the handle 116 in the position as shown in FIGS. 5a and 5b.

Figure 6B:
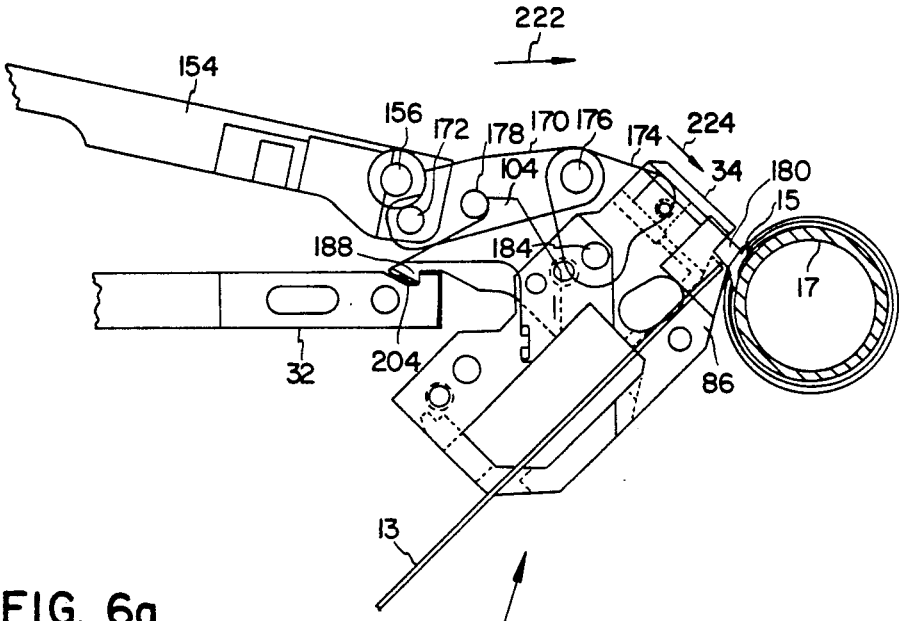
FIGS. 6*a*, *b* and *c* are side cross-sectional views of the cutting operation.
Figure 6A:
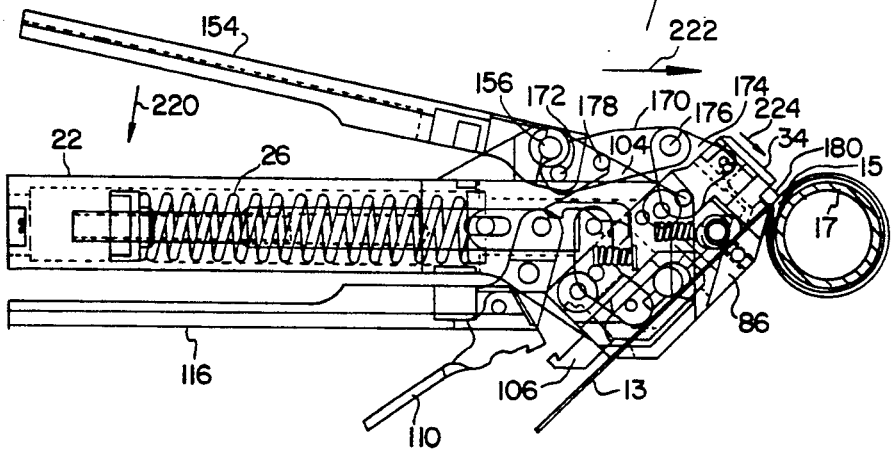
Figure 6C:
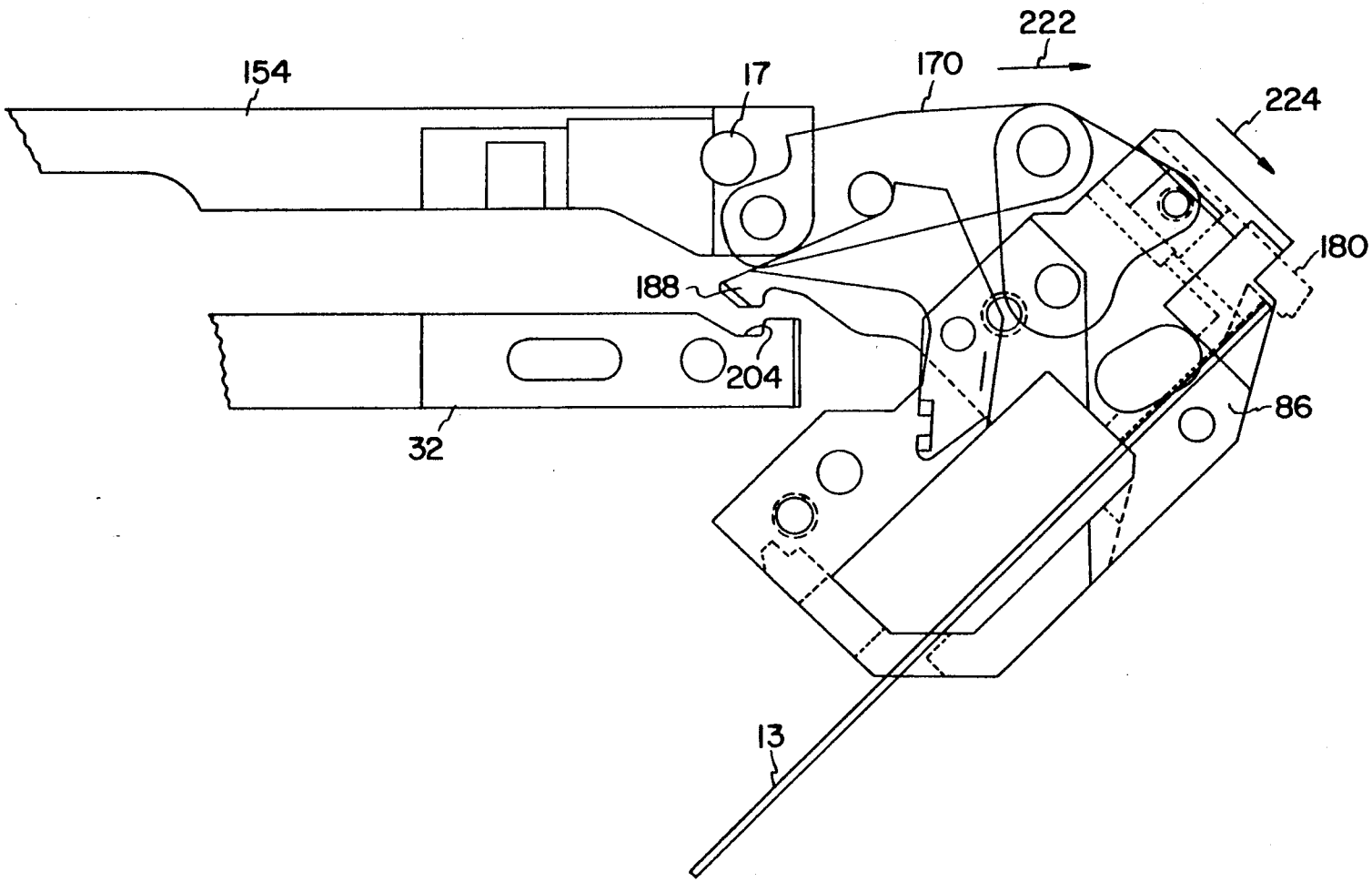

Referring to FIGS. 6a, 6b and 6c, the cut-off sequence is illustrated. Referring first to FIGS. 6a and 6b, the pull up handle 116 is in the uppermost locked position. The cut-off handle 154 pivots in a direction as indicated by an arrow 220 about pin 156 which moves the cut-off links 170 in a direction indicated by an arrow 222. Movement of the links 170 in the direction 222 causes the cut-off arm 174 to pivot clockwise about the pin 184. The clockwise rotation of the cut-off arm 174 moves the cut-off knife 180 in a direction indicated by an arrow 224. The cut-off knife 180 first contacts the buckle 15 and then bends and severs the band 13 therebetween and the cut-off blade 86, as will be subsequently described in greater detail. Simultaneously, the pin 178 contacts the tension holding hook 104 to push the hook 104 in the direction 222 and thus release the hook 188 from the slot 204 ( as shown in FIG. 6c) which will allow the pull up handle 116 to return to the extended position as shown in FIG. 3a.

Figure 7B:
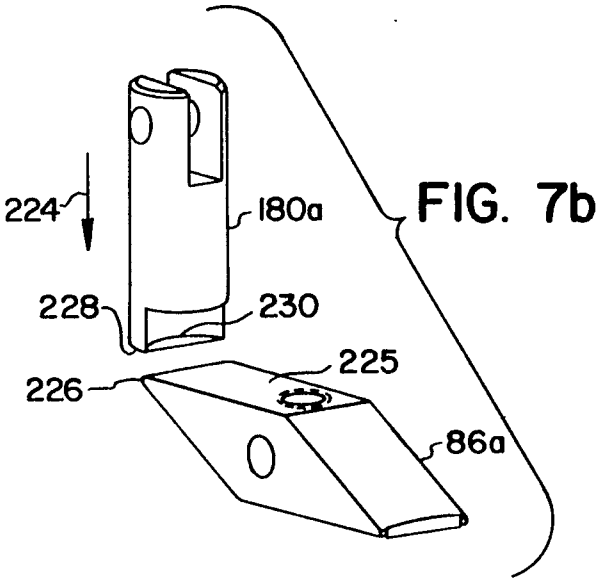
FIGS. 7*a* and *b* are isometric views of one embodiment of a locking tab and the hardware required for formation thereof.
Figure 7A:
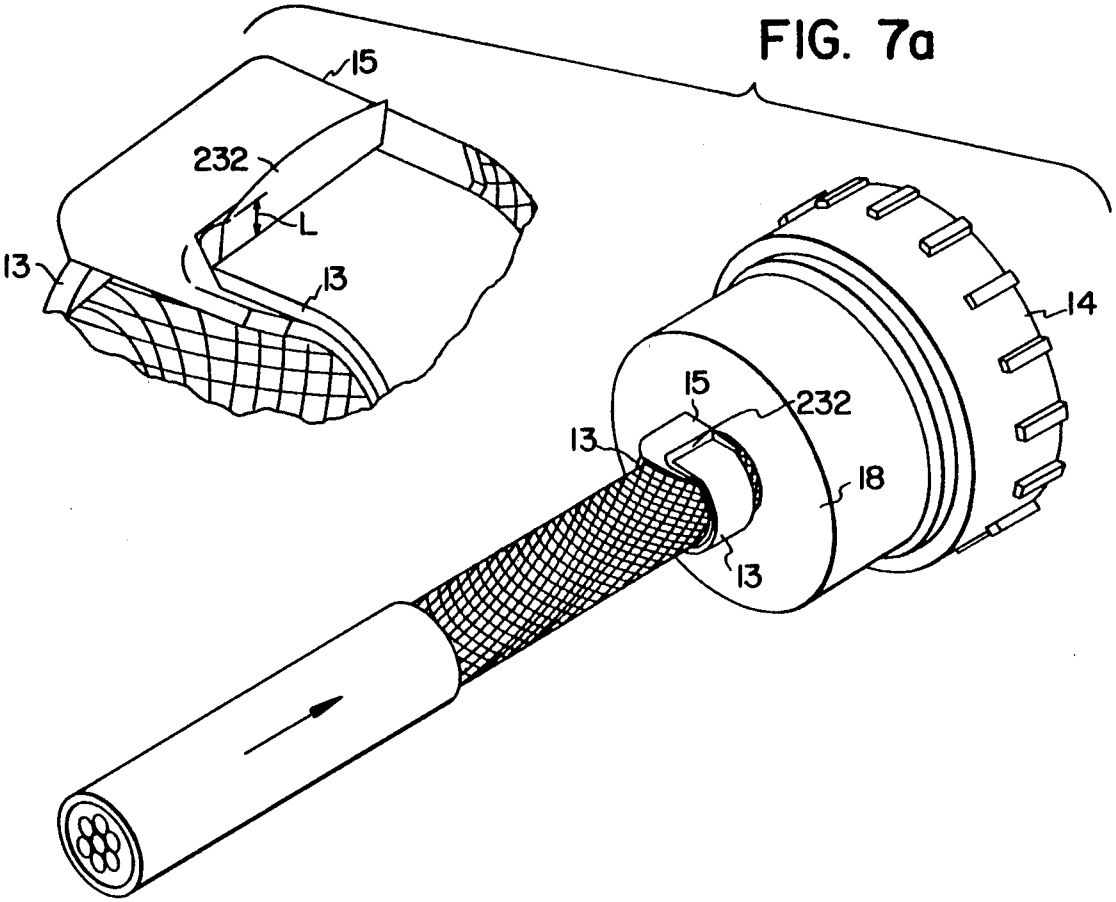

Referring to FIGS. 7a and 7b, one embodiment of a cut-off arrangement is illustrated. Referring first to FIG. 7b, a cut-off blade 86a and a cut-off knife 180a are shown in perspective. The cut-off blade 86a which is reversible within the tool 10, provides a flat surface 225 for cooperation with the tension holding pin 92 to hold the band 13 therebetween. A cutting and ending edge 226 is provided for cooperation with the knife 180a.

As the knife 180a is pushed in the direction 224 by movement of the cut-off handle 154, a lower surface 228 thereof first contacts the buckle 15. Interaction between the lower surface 228, the buckle 15 and the upper surface 225 of the blade 86a causes the band 13 to be first bent and then severed. Due to an arcuate cutter 230 on the cut-off knife 180a, an arcuate tab 232 as shown in FIG. 7a is formed. The length L of the tab 232 is controlled by the thickness of the buckle 15 and the vertical location of the arcuate cutting edge 230. As the buckle 15 is pushed in the direction 224 by the knife 180a, the band 13 is bent by the buckle 15 before being severed by the arcuate cutter 230.

Figures 8A, 8B:
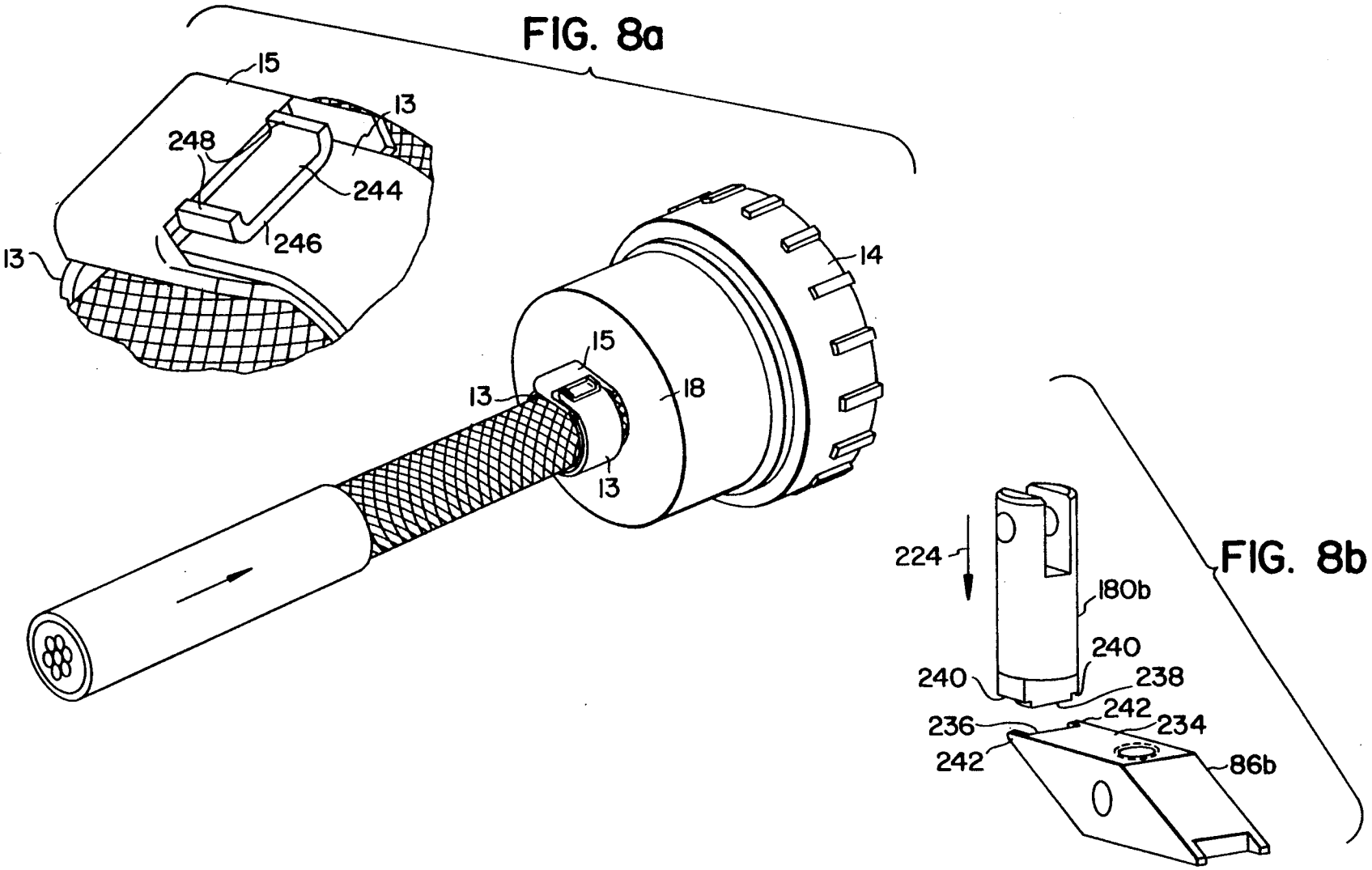
FIGS. 8*a* and *b* are isometric views of another embodiment of a locking tab and the hardware required for formation thereof.

Referring to FIGS. 8a and 8b, an alternative cutting arrangement is illustrated. Referring first to FIG. 8b, a cut-off blade 86b and a cut-off knife 180b are shown. The knife 180b has a flat surface 234 and a bending/cutting edge 236. The blade 86b has a stepped bottom surface 238 having a width W matching a width w of the bending/cutting edge 236. Thus as the knife 180b moves in the direction 224, the lower surface 238 comes into contact with the band 13 beyond the buckle 15. The band 13 is forced into the width w of the blade 86b by the bottom surface 238. When the shoulders 240 of the knife 180b come into contact with the extensions 242 of the blade 86b, the band 13 has been bent and severed into a tab 244 as shown in FIG. 8a. Thus the tab 244 is formed with a straight cut-off edge 246 and a pair of retention ears 248. The retention ears 248 help secure the band 13 to the buckle 15 to prevent loss of tension therein.

Referring again to FIGS. 3a, 4a, 5a, 6a and 6b, another aspect of the present invention is shown. As can be seen in FIG. 3a, the buckle 15 is positioned at an angle relative to the portion of the band 13 passing therethrough for insertion into the tool 10. As can be seen in FIGS. 4a and 5a, the cut-off knife 180 only partially touches the buckle 15 and thus the tool 10 does not interfere with this angled relationship throughout the tensioning of the band clamp 12 around the shield 17. As shown in FIGS. 6a–6b, once the proper tension is achieved and the clamp 12 is to be secured in place, the cut-off knife 180 contacts and depresses the buckle 15 into a generally parallel position relative to the band 13. Thus, easy passage of the band 13 through the buckle 15 is no longer allowed.

Since it is important to the convenient use of the tool 10 to be able to tension the clamp 12 proximate the couple 14, the width of the tool 10 has been designed to be as close to the width of the band 13 as possible. Thus it is possible to place the tool 10 against the flange 18 and have the clamp 12 installed with a minimum amount of space therebetween. Similarly, the tool 10 has been designed for ease of operation by using the lever 44 rather than toggles as is found in the prior art. Finally, the angular relationship between the tensioning assembly and the head 36 provides a tool that is easy to load and that applies more of the work force to tensioning the band 13 than in previous devices.

Although the present invention has been described with respect to a specific preferred embodiment thereof, various changes and modifications may be suggested to one skilled in the art and it is intended that the present invention encompass such changes and modifications as fall within the scope of the appended claims.

I clam:

1. A device for tensioning a band clamp of the type having a band and a buckle, comprising:

means for tensioning including a force storing device in which said means has a first longitudinal axis, said means for tensioning further comprising a tension adjustment plunger, a tension adjustment screw, and a connecting rod; and means for transferring tension from said force storing device to the band, said means for transferring having a second longitudinal axis, wherein said first axis and said second axis intersect at an oblique angle and the band remains straight, said means for transferring tension for interconnection to said connecting rod.

2. The device of claim 1, wherein said force storing devices comprises:

a compression spring.

3. The device of claim 1, wherein said force storing device comprises:

a rubber block.

4. The device of claim 1, wherein said force storing device comprises:

a power cylinder.

5. The device of claim 1, further comprising:

a pull up handle interconnected to said means for tensioning.

6. The device of claim 1, further comprising:

a tension holding link operably connected to said means for tensioning, wherein said link provides a signal when the band clamp has been properly tensioned.

7. The device of claim 1, further comprising:

means for inserting the band into the device.

8. A device for tensioning a band clamp of the type having a band and a buckle, comprising:

means for tensioning including a force storing device in which said means has a first longitudinal axis; and means for transferring tension from said tensioning means to the band, said means for transferring having a second longitudinal axis, wherein said first axis and said second axis intersect at an oblique angle and the band remains straight, said means for transferring tension comprising:

at least one push link connected at a first end thereof to said means for tensioning by an adjustable means for connecting;

a tension transfer lever connected to said push link at a second end of said push link; and a tension block connected to said lever, wherein said block grips and pulls the band.

9. The device of claim 8, wherein said adjustable means for connecting comprises:

an elongated slot in said means for tensioning;

a support plunger slidable relative to said elongated slot; and a pin received within said slot and said first end of said push link.

10. The device of claim 8, wherein said block comprises:

a shaped portion having an elongated slot therein;

a pin slidably received within said slot; and spring means for biasing said pin to hold the band between said pin and a bottom portion of said shaped portion.

11. The device of claim 10, wherein said elongated slot is formed at an angle relative to said bottom portion.

12. A device for tensioning a band clamp of the type having a band and a buckle, comprising:

means for tensioning including a force storing device in which said means has a first longitudinal axis;

means for transferring tension from said force storing device to the band, said means for transferring having a second longitudinal axis, wherein said first axis and said second axis intersect at an oblique angle and the band remains straight; and means for securing the buckle to the band when the band is properly tensioned.

13. The device of claim 12, wherein said means for securing comprises:

a cutoff handle pivotally attached to the device;

at least one cutoff link pivotally attached at a first end thereof to said handle;

a cutoff arm pivotally connected to a second end of said cutoff link;

a cutoff knife; and a cutoff blade, wherein said handle pushes said knife with said link and said arm into bending/cutting cooperation with said blade.

14. The device of claim 13, wherein said knife further comprises:

an arcuate cutter for forming an arcuate cutoff edge.

15. The device of claim 13, wherein said knife further comprises:

a stepped bottom surface for forming a straight cutoff edge having upwardly extending ears for retention by the buckle.

16. A device for tensioning a band clamp of the type having a band and a buckle, comprising:

means for tensioning including a force storing device in which said means has a first longitudinal axis;

means for transferring tension from said force storing device to the band, said means for transferring having a second longitudinal axis, wherein said first axis and said second axis intersect at an oblique angle and the band remains straight; and means for inserting the band into the device, said means for inserting comprising:

a tension hold/release hook pivotally attached to the device; and a tension hold/release link operably connected to said hook, wherein activation of said hook moves said link to provide an opening for the bank.

17. A device for tensioning a band clamp of the type having a band and a buckle, comprising:

means for tensioning including a force storing device in which said means has a first longitudinal axis;

means for transferring tension from said force storing device to the band, said means for transferring having a second longitudinal axis, wherein said first axis and said second axis intersect at an oblique angle and the band remains straight; and means for automatically adjusting said means for transferring tension.

18. The device of claim 17, wherein said means for automatically adjusting comprises:

a tension hold link operably connected to a tension pin and a tension holding pin, wherein movement of said tension holding pin is transferred to said tension pin by said link.

19. A device for tensioning a band clamp of the type having a band and a buckle, comprising:

means for tensioning including a force storing device in which said means has a first longitudinal axis;

means for transferring tension from said force storing device to the band, said means for transferring having a second longitudinal axis, wherein said first axis and said second axis intersect at an oblique angle and the band remains straight; and means for holding tension in the band during tensioning thereof.

20. The device of claim 19, wherein said means for holding tension comprises:

a tension holding pin slidably received in an elongated slot operably connected to said means for transferring tension; and spring means for biasing said pin into gripping contact with the band.

21. A self-adjusting tensioning tool for tensioning a band around a material, comprising:

first means for releasably gripping and pulling a portion of the band to be tensioned, said first means having a stroke distance through which the band is pulled;

second means for releasably gripping another portion of the band when said first means releases the band, said second means responsive to a force on the band created by the material being clamped; and means for adjusting responsive to said second means, wherein said stroke distance is automatically adjusted thereby.

22. The tool of claim 21, wherein said first means comprises:

a block slidably received within a band receiving head;

a tension pin slidably received by an elongated slot in said block; and first spring means for biasing said tension pin into contact with the band.

23. The tool of claim 22, wherein said second means comprises:

a tension holding pin slidably received by an elongated slot in said band receiving head; and second spring means for biasing said tension holding pin into contact with the band.

24. The tool of claim 23, wherein said means for adjusting comprises:

a tension hold/release link operably connected between said tension holding pin and said tension pin, wherein movement of said tension holding pin allows a corresponding movement by said tension pin.

25. A device for signalling an operator of a tensioning tool that a band is properly tensioned, comprising:

a force storing device adjustably pre-compressed in an amount approximately equal to a desired tension in the band; and mating means which only mate when tension in the band approximately equals said pre-compressed amount, wherein a signal is provided to the operator that the band is properly tensioned, said mating means comprising:

a rod operably connected to said force storing device, said rod having a slot therein; and a tension holding hook receivable by said slot only when the band approximately reaches said desired tension.

26. An improved tensioning device, comprising:

an adjustable force storing device lying substantially along a first axis;

means for transferring tension lying substantially along a second axis, wherein said first axis intersects said second axis, said means for transferring tension comprising:

at least one push link connected at a first end thereof to said force storing device by an adjustable means for connecting;

a tension transfer lever connected to said push link at a second end of said push link; and a tension block connected to said lever, wherein said block grips and pulls the band; and means for interconnecting said force storing device to said means for transferring tension, wherein a band to be tensioned is substantially coaxial with said means for transferring tension allowing easy loading, unloading and tensioning thereof.

27. The device of claim 26, wherein said adjustable connecting means comprises:

an elongated slot in a portion of said force storing device;

a support plunger slidable relative to said elongated slot; and a pin received within said slot and said first end of said push link.

28. The device of claim 26, wherein said block comprises:

a shaped portion having an elongated slot therein;

a pin slidably received within said slot; and spring means for biasing said pin to hold the band between said pin and a bottom portion of said shaped portion.

29. The device of claim 28, wherein said elongated slot is formed at an angle relative to said bottom portion.

30. A method for reducing forces from a buckle on a band which interfere with tensioning thereof by a band tensioning tool, comprising the steps of:

positioning the band in the tool such that substantially all of the tail portion of the band to be tensioned approximately parallels a first longitudinal axis through a tension transferring section of the tool; and positioning a band bending/cutting knife above said first axis and the band and substantially parallel to a second axis intersection said first axis, wherein relatively more portions of said knife touch the buckle when cutting the band than when tensioning the band, such that forces on the band are reduced during tensioning.

31. A device for tensioning a band clamp of the type having a band and a buckle, comprising:

means for tensioning having a first longitudinal axis, said means including:

a force storing device;

a tension adjustment plunger;

a tension adjustment screw; and a connecting rod for interconnection to a means for transferring tension; and means for transferring tension from said means for tensioning to the band, said means for transferring having a second longitudinal axis, wherein said first axis and said second axis intersect at an oblique angle and the band remains straight.

* * * * *